US011763962B2

(12) United States Patent
Hiramatsu

(10) Patent No.: US 11,763,962 B2
(45) Date of Patent: Sep. 19, 2023

(54) CABLE

(71) Applicant: Junkosha Inc., Kasama (JP)

(72) Inventor: Shigeo Hiramatsu, Kasama (JP)

(73) Assignee: Junkosha Inc., Kasama (JP)

( * ) Notice: Subject to any disclaimer, the term of this patent is extended or adjusted under 35 U.S.C. 154(b) by 628 days.

(21) Appl. No.: 16/954,699

(22) PCT Filed: Dec. 19, 2018

(86) PCT No.: PCT/JP2018/046845
§ 371 (c)(1),
(2) Date: Jun. 17, 2020

(87) PCT Pub. No.: WO2019/124455
PCT Pub. Date: Jun. 27, 2019

(65) Prior Publication Data

US 2023/0053113 A1 Feb. 16, 2023

(30) Foreign Application Priority Data

Dec. 20, 2017 (JP) ..... 2017-244560
Dec. 19, 2018 (JP) ..... 2018-237503

(51) Int. Cl.
*H01B 7/02* (2006.01)
*H01B 3/44* (2006.01)
(Continued)

(52) U.S. Cl.
CPC ..... *H01B 7/0225* (2013.01); *H01B 3/445* (2013.01); *H01B 11/1843* (2013.01);
(Continued)

(58) Field of Classification Search
CPC . H01B 3/30; H01B 3/445; H01B 7/02; H01B 7/0225; H01B 7/28; H01B 11/1843;
(Continued)

(56) References Cited

U.S. PATENT DOCUMENTS 5,210,377 A * 5/1993 Kennedy ..... H01B 11/1839 174/107
5,237,635 A 8/1993 Lai
(Continued)

FOREIGN PATENT DOCUMENTS

CN 101889316 A 11/2010
CN 102197077 A 9/2011
(Continued)

*Primary Examiner* — William H. Mayo, III
(74) *Attorney, Agent, or Firm* — The Webb Law Firm

(57) ABSTRACT

An insulating cable having a conductor and an insulator configured by a plurality of resin layers on the conductor, wherein the plurality of resin layers contain the same kind of fluorine resin, a difference in refractive index between a resin layer having the largest refractive index and a resin layer having the smallest refractive index among the plurality of resin layers is 0.03 or less, a layer thickness of an outermost resin layer of the insulator is 0.03 mm or less, and a deviation (coefficient of variation CV) in thickness of the insulator in a cross-section perpendicular to a longitudinal direction of the cable is 0.035 or less.

6 Claims, 1 Drawing Sheet

(51) Int. Cl.
*H01B 11/18* (2006.01)
*H01B 13/06* (2006.01)
*H01B 13/14* (2006.01)

(52) U.S. Cl.
CPC ..... *H01B 11/1895* (2013.01); *H01B 13/067* (2013.01); *H01B 13/141* (2013.01); *H01B 13/148* (2013.01)

(58) Field of Classification Search
CPC ..... H01B 11/1895; H01B 13/067; H01B 13/141; H01B 13/148
USPC ..... 174/102 R, 103, 106 R, 110 R–122 R
See application file for complete search history.

(56) References Cited

U.S. PATENT DOCUMENTS 5,750,931 A * 5/1998 McGregor ..... C08J 9/32 174/120 R
5,841,072 A * 11/1998 Gagnon ..... H01B 7/295 428/461
7,105,749 B2 * 9/2006 Belli ..... H01B 7/185 174/110 F
2010/0218975 A1 9/2010 Mehan
2011/0203830 A1 * 8/2011 Kono ..... H01B 3/445 174/120 C
2013/0168149 A1 7/2013 Gundel
2015/0027746 A1 1/2015 Gundel

FOREIGN PATENT DOCUMENTS

CN 102334168 A 1/2012
JP H06208808 A 7/1994
JP H08255513 A 10/1996
JP 2011108492 A 6/2011
JP 2011253647 A 12/2011
JP 2012507832 A 3/2012
JP 2016189336 A 11/2016
KR 19990073899 A 10/1999
KR 20110122206 A 11/2011
WO 9307627 A1 4/1993

* cited by examiner

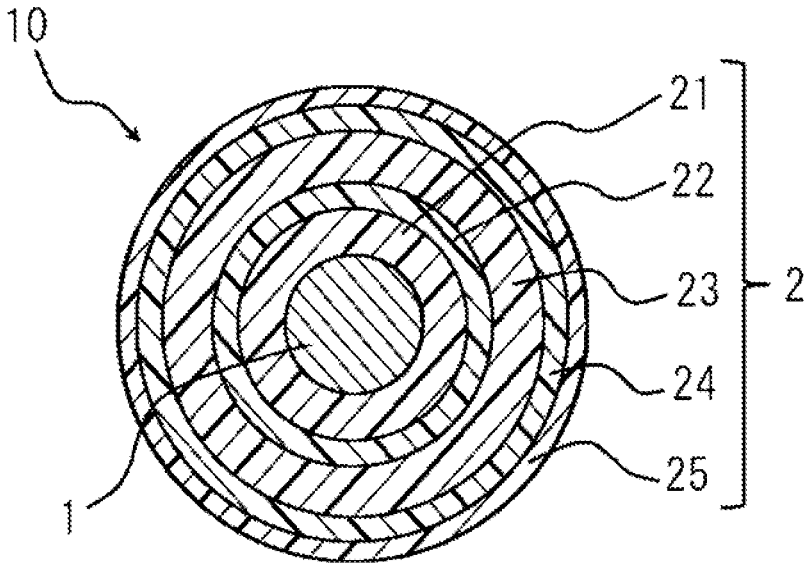
10
21
22
23
2
24
25
1

CABLE

CROSS-REFERENCE TO RELATED APPLICATIONS

This application is the United States national phase of International Application No. PCT/JP2018/046845 filed Dec. 19, 2018, and claims priority to Japanese Patent Application Nos. 2017-244560 filed Dec. 20, 2017 and 2018-237503 filed Dec. 19, 2018, the disclosures of which are hereby incorporated by reference in their entirety.

BACKGROUND OF THE INVENTION

Field of the Invention

The present invention relates to a cable, particularly, an insulating cable having an excellent withstanding voltage characteristic suitable for sliding, such as a robot cable, and the like.

Description of Related Art

A fluorine resin has excellent characteristics such as high insulating durability, good heat resistance, oil resistance, and chemical resistance, and the smallest permittivity among plastic insulators. The fluorine resin is suitably used as insulators of insulating wires used for wirings of electrical and electronic devices (particularly, a robot cable and the like). In terms of the use thereof, as devices are miniaturized and advance highly in performance, a more flexible and a diameter-reduced cable is required for the insulating cable. However, if a cable diameter is reduced, mechanical strengths such as abrasion resistance and the like may be reduced.

In order to enhance flexibility of a cable, for example, there is an insulting cable in which an elastomer containing cross-linking fluorine is coated on a conductor and a cross-linking fluorine resin is coated thereon and thereby an insulation layer is formed. Also, in order to enable diameter reduction, for example, patent document 1 proposes an insulating wire in which a combination of two kinds of different fluorine resins (i.e., ETFE having excellent mechanical characteristic and oil resistance and FEP having excellent heat resistance) is extrusion-coated as an insulator on a conductor.

If a cable diameter is reduced, a total thickness of an insulation layer on a conductor gets to be thin, and as a result, there is a concern that as withstanding voltage characteristics as well as mechanical strengths such as abrasion resistance and the like are deteriorated, a characteristic needed for a robot cable may not be sufficiently obtained. However, the above-described insulating wire has a purpose of improving flexibility, and mechanical strengths such as abrasion resistance and the like of an insulation layer of a cable, but it has not been discussed to satisfy diameter reduction and improvement of a withstanding voltage characteristic.

PRIOR ART REFERENCE

Patent Document

Japanese patent laid-open publication No. H08-255513

SUMMARY OF THE INVENTION

Technical Problem

The present invention is proposed in consideration of the problem and has a purpose to provide an insulating cable suitable for sliding by improving the withstanding voltage characteristic needed for cable diameter reduction in an insulating cable.

Solution to the Problem

The purpose is achieved by an insulating cable including a conductor, and an insulator configured by a plurality of resin layers on the conductor, wherein the plurality of resin layers contain the same kind of fluorine resin, a difference in refractive index between a resin layer having the largest refractive index and a resin layer having the smallest refractive index in the plurality of resin layers is 0.03 or less, a layer thickness of an outermost resin layer of the insulator is 0.03 mm or less, and a deviation (coefficient of variation CV) in thickness of the insulator in a cross-section perpendicular to longitudinal direction of the cable is 0.035 or less.

Effects of the Invention

A cable of the present invention is improved in withstanding voltage characteristic such that diameter reduction becomes possible, and the cable has excellent flexibility. Also, since the cable is suitable for sliding, the cable may be suitably used for, in particular, robot cables and the like.

BRIEF DESCRIPTION OF THE DRAWINGS

FIG. 1 is a mimetic view of a cross-section illustrating an example of an insulating wire according to an embodiment of the present invention.

DESCRIPTION OF THE INVENTION

Hereinafter, a cable according to the present invention will be described in detail. Embodiments described below do not limit the present invention by claims, and moreover, all combinations of features explained among embodiments are not essential for accomplishment of the present invention.

FIG. 1 is a mimetic view illustrating an example of a cable according to the present invention. As illustrated in FIG. 1, a cable 10 of the present invention is configured by coating an insulator 2 on a conductor 1. The insulator is configured by at least two layers, and each of resin layers 21 to 25 configuring the insulator 2 is constituted by a resin or a resin composition which mainly uses a fluorine resin having almost the same refractive index. A difference in refractive index between a resin layer having the largest refractive index and a resin layer having the smallest refractive index is 0.03 or less. Generally, the fluorine resin has a refractive index of 1.34 to 1.46, and the refractive index is hardly changed in general coloring. For example, when each resin layer configuring the insulator 2 is constituted by the same kind of fluorine resin, a difference in refractive index between a resin layer having the largest refractive index and a resin layer having the smallest refractive index in the insulator 2 becomes 0.03 or less. In the fluorine resin (particularly, ethylene-tetrafluoroethylene (ETFE) and the like), it is difficult to perform extrusion in thin thickness under a general molding condition, and if coating is per-formed in thin thickness, a deviation tends to occur in thickness. Due to this, in a conventional cable, if the fluorine resin is stacked as a plurality of layers, a deviation in thickness of a cable increases furthermore. If a deviation occurs in an insulator thickness of a cable, insulation breakdown occurs at a portion in which an insulator is thin. The cable of the present invention controls an in-mold flow of a melt resin, and thus, when an insulator is configured by a plurality of layers, it becomes possible to suppress a deviation in thickness of the insulator to be small. In specific, in order to control a directionality of an in-mold flow causing a defective portion or a not evenly thick coating of an insulator, a flow in a direction other than a direction parallel to an extrusion direction is suppressed by strongly applying a resin pressure at a front end of a die outlet, and a deviation in thickness of the insulator is suppressed by installing a die land in a length twice compared with a conventional length and performing extrusion. If the die land gets longer, an external appearance of an insulator tends to be deteriorated, but a resin constituting an outermost resin layer is constituted by a resin having high fluidity and high melt tension and thereby it is possible to have a cable with good surface state of an outer surface. If an insulator of a cable is configured by a stacked body of a plurality of resin layers and an outermost layer of 0.03 mm or less is formed, a defective portion of each resin layer is uniformized as a whole insulator, a withstanding voltage characteristic is improved, and it becomes possible to have a small deviation of a cable characteristic. That is, with respect to the cable of the present invention, when each resin layer configuring the insulator is stacked, a deviation in thickness is suppressed to be small and a deviation (coefficient of variation CV) in thickness of the insulator in a cross-section perpendicular to a longitudinal direction of the cable is set to be 0.035 or less. Accordingly, the insulator is molded in thin coating to have a thin thickness, and the diameter of the insulator gets to be reduced such that the cable gets to have high withstanding voltage characteristic, and a stable withstanding voltage and a mechanical characteristic.

The conductor of the cable according to the present invention may use a conductor used for general insulating wires and the conductor is configured by a metal wire such as a copper wire, a silver wire, an aluminum wire, an alloy wire thereof, and the like. Also, the metal wire may be coated through silver plating, zinc plating, nickel plating, aluminum plating, and the like. The conductor may be one of a single wire or a stranded wire with multiple conductors, and a cross-section may be one of a round wire and a rectangular wire.

The insulator configured by the plurality of resin layers of the cable according to the present invention is configured by a resin which mainly uses the same kind of fluorine resin in any layer. Each resin layer may be constituted by mixing one kind or two or more kinds of resins, or may be constituted by a resin compound containing a pigment or other functional fillers and the like. In this case, a resin which is contained in the highest content in the resin layer mainly constitutes the corresponding resin layer. The fluorine resin used for the present invention is a thermoplastic fluorine resin enabling melt extrusion molding such as ethylene-tetrafluoroethylene copolymer (ETFE), tetrafluoroethylene-hexafluoropropylene copolymer (FEP), or tetrafluoroethylene-perfluoroalkylvinylether copolymer (PFA), and the like. With respect to the fluorine resins, grade and the like of extrusion molding is defined as ASTM standard for each copolymer. Whether kinds of fluorine resins of the resin layers configuring the insulator are the same kind is determined by whether the fluorine resins are suitable for the same standard number based on a rule of the ASTM standard. The main resin of each resin layer configuring the insulator is the same kind and may use a resin of the same grade or a resin of a different grade. With respect to a grade of a resin used for an outermost layer, it is preferable to use a grade having the same melt flow rate (MFR) as an inner layer or a grade having higher MFR than the inner layer.

In the cable of the present invention, the insulator is configured by a stacked layer of at least two resin layers. It is preferable that a plurality of resin layers are coated on a conductor by performing co-extrusion. By performing the co-extrusion, adhesive strength between resin layers increases and it is difficult for partial detachment between the resin layers to occur despite sliding, and thus the insulator may be used for sliding of robot cables and the like. Also, by configuring the insulator in a plurality of layers, it becomes possible that insulation breakdown strength per unit thickness is high at a portion in which a layer thickness is thin, and that if there is no defect between an inner layer and an outer layer, a withstanding voltage characteristic as a whole insulator may be improved.

In the cable of the present invention, it is preferable that a resin layer having a thickness of at least 50% or more in the entire thickness which sums thickness of each of the resin layers configuring the insulator does not include a material having a permittivity which differs from that of a fluorine resin mainly configuring a resin layer such as a functional filler or a pigment. It is preferable that a containing rate is 0.05 wt % or less. By placing a resin layer including no material having a different permittivity, there will be no portion in which an electrical power wire concentrates in the resin layer and thereby the insulator has a high withstanding voltage characteristic. Accordingly, a high withstanding voltage characteristic as a whole cable is improved and it may be achieved for the insulator to be thinly coated and to have a reduced diameter. Also, since a resin compound in which a functional filler or a pigment and the like are mixed has a different permittivity and different insulation breakdown strength according to the kind and the concentration of a filler or a pigment, there has been a problem that a deviation occurs in a withstanding voltage of the cable. However, the problem may be solved by placing 50% or more of a resin layer which does not include the materials. When a round or flat multicore cable using one or a plurality of cables of the present invention is used, a whole cable may get to have reduced diameter by maintaining a high withstanding voltage, and moreover the cable may be usefully for a use as a balanced cable.

A layer thickness of an outermost layer of the cable of the present invention is 0.03 mm or less. Since a resin used for the outermost layer has high fluidity and high melt tension, a uniform resin is preferable. Since a layer thickness is thin, the shape of the cable is maintained even if a resin having high fluidity is coated. Also, as melt tension is high, it is difficult for a surface state of an inner layer to be affected. Accordingly, a surface state of the outer layer gets to be more smooth and uniform and a withstanding voltage is improved. Also, when a resin compound in which a filler or a pigment is mixed is disposed at the outermost layer, a layer thickness of the outermost layer is thin, and thus, even when the filler or the pigment is combined in a high concentration, a withstanding voltage characteristic may be less affected accordingly.

An insulator configured by the plurality of resin layers of the cable of the present invention is useful for a dielectric layer of a coaxial cable. Since the insulator is configured by resins having the same refractive index, the same permittivity as that of a dielectric layer configured by one layer is maintained.

The present invention will be described below in more detail with reference to the following embodiments. The following embodiments are exemplary embodiments of the present invention, and details of the present invention are not limited by the following embodiments.

EMBODIMENTS

<Measurement of a Thickness of an Insulator>

A thickness of an insulator in a cross-section perpendicular to a longitudinal direction of a completed sample cable is measured by using a microscope. With respect to the number of measured portions, ten or more portions based on a total length of a cable are uniformly measured. A thickness of the insulator is measured as a length between an outer surface of the cable and an interface between a conductor and the insulator in a straight line passing through a center of the conductor. In the same manner, a thickness of each resin layer is measured as a length between an interface of the conductor or a resin layer and an outer surface of the resin layer or the cable in the straight line passing through the center of the conductor. In a case where a rectangular wire is used for the conductor, the thickness of the insulator is measured as a length between the outer surface of the cable and the interface between the conductor and the insulator in a straight line perpendicularly intersected with the interface between the conductor and the insulator. In the same manner, the thickness of each resin layer is measured as a length between the interface of the conductor or the resin layer and the outer surface of the resin layer or the cable in a straight line perpendicularly intersected with the interface between the conductor and the insulator. The thickness of the insulator is equal to a sum of thicknesses of all resin layers. The thickness of the insulator and the thickness of each resin layer are calculated by measuring eight or more portions with respect to one cross-section, and a deviation (coefficient of variation CV) in thickness of the insulator is calculated. An average value of deviations (coefficient of variation CV) in thickness of the insulator in a cross-section, calculated from each measured portion in a total length of the cable is calculated and is set to be the deviation (CV) in thickness of the insulator.

<Measurement of Breakdown Voltage>

Insulation layers of both terminals of the sample cable cut by 1,000 mm are stripped and submerged, a voltage is applied to a portion between a conductor and an underwater electrode at a velocity of 500 V/sec, and a voltage is measured when broken down. Breakdown electric field strength is calculated based on the following formula.

[Formula 1]

$$E = \frac{V}{r_1 \times \ln\left(\frac{r_3}{r_2}\right)} \quad \text{Formula (1)}$$

Embodiment 1

An annealed copper wire having a diameter of 0.65 mm as a conductor is used. An ETFE resin composition (MFR 10 g/10 min) in which ETFE (MFR 10 g/10 min(ASTM-D3159 (297° C.×49N)) having a thickness of 0.22 mm is mixed with a white pigment having a thickness of 0.03 mm has been extrusion-coated on the conductor through co-extrusion, and an insulator having a thickness of 0.25 mm is used.

Embodiment 2

An annealed copper wire having a diameter of 0.65 mm is used as a conductor. An ETFE resin composition (MFR 11 g/10 min) in which ETFE (MFR 10 g/10 min) having a thickness of 0.37 mm is mixed with a white pigment having a thickness of 0.03 mm has been extrusion-coated on the conductor, and an insulator having a thickness of 0.40 mm is used.

Embodiment 3

An annealed copper wire having a diameter of 0.65 mm is used as a conductor. ETFE (MFR 11 g/10 min) having a thickness of 0.12 mm and ETFE (MFR 11 g/10 min) having a thickness of 0.03 mm have been coated on the conductor through co-extrusion, and an insulator having a thickness of 0.15 mm is used.

Embodiment 4

A conductor having a diameter of 0.54 mm, which is made by stranding seven silver-plated copper wires having a diameter of 0.18 mm, is used. ETFE (MFR 10 g/10 min) having a thickness of 0.37 mm, ETFE (MFR 11 g/10 min) having a thickness of 0.058 mm, and ETFE (MFR 11 g/10 min) having a thickness of 0.045 mm have been coated on the conductor through co-extrusion. An ETFE resin composition (MFR 12 g/10 min) in which ETFE (MFR 12 g/10 min) having a thickness of 0.018 mm is mixed with a white pigment having a thickness of 0.012 mm has been extrusion-coated on an outer circumference of the coated conductor, and an insulator having a thickness of 0.485 mm is used.

Comparative Example 1

A cable in which a coated layer of the embodiment 1 is configured by one layer has been produced. An annealed copper wire having a diameter of 0.65 mm is used as a conductor, and an ETFE resin composition (MFR 10 g/10 min) mixed with a white pigment having a thickness of 0.25 mm has been extrusion-coated on the conductor, and an insulator having a thickness of 0.25 mm is used. The white pigment has been adjusted so that a mixture amount thereof in a whole insulator becomes equal to a mixture amount in a resin compound layer of the embodiment 1.

Comparative Example 2

A cable in which a coated layer of the embodiment 2 is configured by one layer has been produced. An annealed copper wire having a diameter of 0.65 mm is used as a conductor, and an ETFE resin composition (MFR 11 g/10 min) mixed with a white pigment having a thickness of 0.40 mm has been coated extrusion-coated on the conductor, and an insulator having a thickness of 0.40 mm is used. The white pigment has been adjusted so that a mixture amount thereof in a whole insulator becomes equal to a mixture amount in a resin compound layer of the embodiment 2.

Comparative Example 3

A cable in which a coated layer of the embodiment 3 is configured by one layer has been produced. An annealed copper wire having a diameter of 0.65 mm is used as a conductor, an ETFE (MFR 11 g/10 min) having a thickness of 0.15 mm has been coated extrusion-coated on the conductor, and an insulator having a thickness of 0.15 mm is used.

With regards to each embodiment and each comparative example, a result of each measurement is shown in Table 1.

TABLE 1

| | Embodiment 1 | Embodiment 2 | Embodiment 3 | Embodiment 4 | Comparative Example 1 | Comparative Example 2 | Comparative Example 3 |
|---|---|---|---|---|---|---|---|
| Conductor Outer Diameter mm | 0.65 | 0.65 | 0.65 | 0.54 | 0.65 | 0.65 | 0.65 |
| Insulator Thickness mm | 0.25 | 0.40 | 0.15 | 0.485 | 0.25 | 0.400 | 0.15 |
| Thickness of Resin Layer 1 mm | 0.22 | 0.37 | 0.12 | 0.37 | | | 0.15 |
| Thickness of Resin Layer 2 mm | | | 0.03 | 0.058 | | | |
| Thickness of Resin Layer 3 mm | | | | 0.045 | | | |
| Thickness of Resin Layer 4 mm | | | | 0.018 | | | |
| Thickness of Resin Compound layer mm | 0.03 | 0.03 | | 0.012 | 0.25 | 0.400 | |
| Breakdown Voltage kV | 43.1 | 50.0 | 26.2 | 33.0 | 35.0 | 45.7 | 23.7 |
| Breakdown Electric Field Strength kV/mm | 225.4 | 188.5 | 206.5 | 122.0 | 188.6 | 174.7 | 183.9 |
| Difference between the largest refractive index and the smallest refractive index | 0.01 | 0.01 | 0.00 | 0.01 | — | — | — |
| Deviation (CV) in thickness of the Insulator | 0.020 | 0.019 | 0.023 | 0.027 | 0.046 | 0.039 | 0.047 |
| Deviation in breakdown electric field strength kV/mm | 4.2 | 0.01 | 2.4 | 2.9 | 14.2 | 16.4 | 4.9 |
| Improvement rate of breakdown electric field strength % | 19.6 | 15.2 | 12.3 | 7.9 | — | — | — |

In an insulator thickness of a cable in which an insulator of an embodiment is configured by a plurality of layers, a deviation (CV) in thickness of the insulator is 0.035 or less, and breakdown electric field strength has been improved by 19.6% to 7.9% comparing with a cable of a comparative example in which a thickness of the same insulator is configured by one layer. Also, a deviation (standard deviation) (σ) of breakdown electric field strength gets to be reduced such that a deviation of a withstanding voltage characteristic is largely reduced.

Embodiment 5

An external conductor has been installed at an outer circumference of the insulator of the cable of embodiment 4 by braiding a silver-plated copper wire having a diameter of 0.12 mm. FEP having a thickness of 0.2 mm has been extrusion-coated on the external conductor, and thus a coaxial cable is produced.

A permittivity of the insulator of the coaxial cable of embodiment 5 has been measured. The insulator of embodiment 5 is configured by a plurality of resin layers, but it has been confirmed that all of the resin layers are configured by a resin having almost the same refractive index and the insulator has the same permittivity as that of a cable in which an insulator is configured by one layer.

REFERENCE NUMBER

10: Insulating Cable
1: Conductor
2: Insulator

The invention claimed is:

1. An insulating cable comprising:

a conductor; and an insulator configured by a plurality of resin layers on the conductor, wherein the plurality of resin layers contain the same kind of fluorine resin, wherein a difference in a refractive index between a resin layer having the largest refractive index and a resin layer having the smallest refractive index among the plurality of resin layers is 0.03 or less, wherein a layer thickness of an outermost resin layer of the insulator is 0.03 mm or less, and wherein a coefficient of variation in thickness of the insulator in a cross-section perpendicular to a longitudinal direction of the cable is 0.035 or less.

2. The insulating cable of claim 1, wherein a melt flow rate (MFR) of a resin used for the outermost resin layer among all the resin layers configuring the insulator is the largest.

3. A coaxial cable using the insulating cable of claim 1.

4. A round or flat multicore cable using the insulating cable of claim 1.

5. A round or flat multicore cable using the coaxial cable of claim 3.

6. A balanced cable including two insulating cables of claim 1 as a pair.

* * * * *